United States Patent [19]

Ryan et al.

[11] 4,395,808

[45] Aug. 2, 1983

[54] SPACER UNIT

[75] Inventors: Robert P. Ryan; Leonard F. Tworek, both of Deerfield, Ill.; James H. Britain, Mobile, Ala.

[73] Assignee: Signode Corporation, Glenview, Ill.

[21] Appl. No.: 286,043

[22] Filed: Jul. 22, 1981

[51] Int. Cl.[3] ..... B21D 39/03; B65D 19/00

[52] U.S. Cl. ..... 29/428; 108/51.1; 108/51.3

[58] Field of Search ..... 206/386, 413, 516, 599; 414/904, 42, 786; 108/51.1, 51.3, 53.1, 52.1, 56.3; 29/428

[56] References Cited

U.S. PATENT DOCUMENTS

| | | | |
|---|---|---|---|
| 1,603,959 | 10/1926 | Leven | 206/413 |
| 2,444,184 | 6/1948 | Cahners | 108/51.1 |
| 2,493,562 | 1/1950 | Yarman | 108/51.3 |
| 2,691,499 | 12/1954 | Watts | 108/51.3 |
| 2,738,153 | 3/1956 | Frase | 108/51.1 |
| 3,088,423 | 7/1963 | Budd | 108/51.3 |
| 3,115,105 | 12/1963 | Allen | 108/51.3 |
| 3,123,020 | 3/1964 | Voissem | 108/56.3 |
| 3,425,367 | 2/1969 | Oravez | 108/51.3 |
| 3,438,342 | 4/1969 | Woolworth et al. | 108/56.3 |
| 3,677,201 | 7/1972 | Chadbuorne | 108/51.1 |
| 3,683,823 | 8/1972 | Schmid | 108/156 |
| 3,697,029 | 10/1972 | Lauffer | 108/51.1 |
| 3,940,101 | 2/1976 | Heidelbach | 108/56.3 |
| 3,942,654 | 3/1976 | Warrick | 108/56.3 |
| 4,051,786 | 10/1977 | Nordgren | 108/51.1 |
| 4,228,744 | 10/1980 | Moore | 108/51.3 |

FOREIGN PATENT DOCUMENTS

| | | | |
|---|---|---|---|
| 2008536 | 6/1979 | United Kingdom | 206/599 |

*Primary Examiner*—Ervin M. Combs
*Assistant Examiner*—Steven E. Nichols
*Attorney, Agent, or Firm*—Dressler, Goldsmith, Shore, Sutker & Milnamow, Ltd.

[57] ABSTRACT

A method and apparatus for handling large articles, such as heavy rolls of paper and the like, is disclosed. At least three composite spacer units, each constructed from a plate and a cylindrical spacer member secured thereto, are attached to a shield fastened on the bottom of each article so as to provide a space beneath each article for receiving lifting members inserted under the article.

8 Claims, 6 Drawing Figures

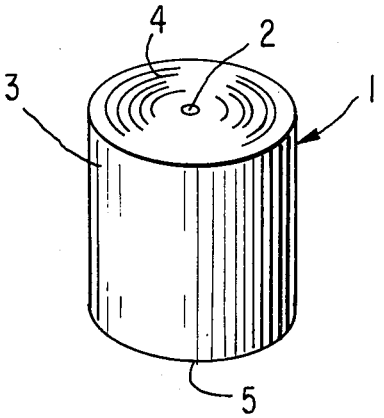
FIG. 1
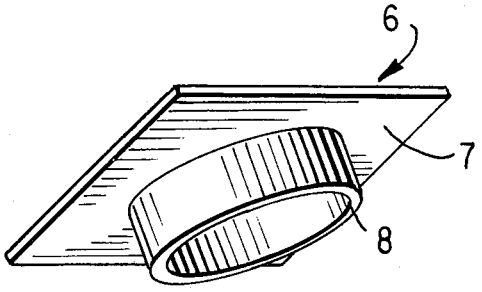
FIG. 2
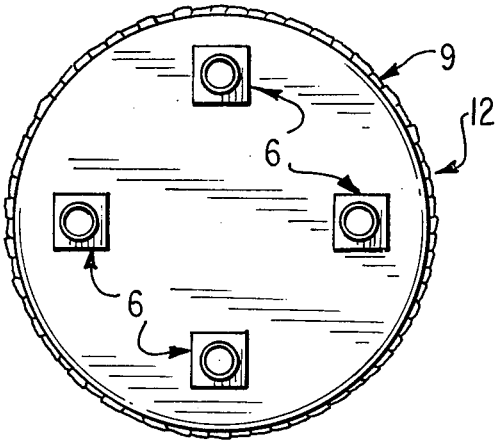
FIG. 4
FIG. 3
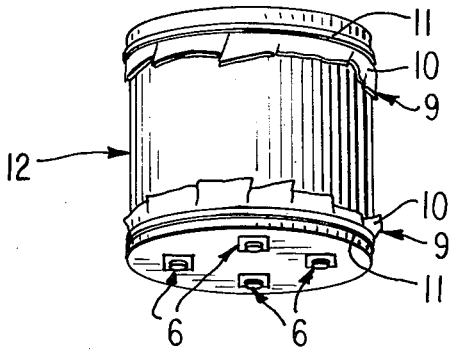

SPACER UNIT

TECHNICAL FIELD

This invention relates to structures used under and between articles to facilitate the use of a forklift or like mechanism when stacking, carrying, or otherwise handling the articles.

BACKGROUND OF THE INVENTION

In the past, it has been common when moving heavy articles to place them upon wood or paperboard pallets which raise the articles above the floor and provide a space for the tines of a forklift to be received underneath. An example of a paperboard pallet for such use is disclosed in the U.S. Pat. No. 2,444,184. Such pallets are typically separate from the articles which they support, though the articles may be strapped to the pallets if desired.

There are several disadvantages with the above-described method and pallet apparatus. For example, extra labor and expense are incurred when strapping the article to the pallet. Also, additional labor and space is required to fabricate and then maintain a supply of bulky pallets for use when needed.

In many situations, it may be convenient to treat such pallets as "disposable" whereby the pallets are shipped with the articles and subsequently discarded. However, this increases the shipping cost of the article. In order to reduce article handling costs, it has become economically desirable to assume the burden of storing and reusing the pallets when possible.

It would be desirable to provide a relatively inexpensive structure for effecting bottom spacing in a manner similar to the above-described pallets. Moreover, it would be advantageous if the spacer structure construction and materials could be economically and conveniently used on a "one time" basis. The structure could be subsequently disposed of with relatively little additional labor or handling costs. One such structure is the paperboard pallet disclosed in the above-referenced U.S. Pat. No. 2,444,184. The pallet is of conventional rectangular design and is a self-contained, non-attached, single unit structure intended to be used with any number of articles having a large variety of shapes and sizes.

Conventional pallets, such as the one disclosed in the above-referenced U.S. Pat. No. 2,444,184, are typically constructed with the least amount of carpenter work or labor. They generally have simple shapes, such as squares or rectangles. When handling cylindrical objects such as paper rolls, the excess size and corner portions of the pallets result in inefficient storage of the cylindrical objects.

When items such as large paper rolls, it is desirable that the item be properly supported and raised above the floor. This permits the tines of a forklift to be inserted beneath the item without damage. In the past, the space beneath and between paper rolls was provided by pallets, by two-by-fours, or by a sandwich made from two large pieces of corrugated paper which had been fixed together in a spaced arrangement by numerous slices of paper roll cores. These spacer structures, because they were not attached to the paper rolls, sometimes required special handling to ensure their proper placement under and between rolls of paper. Further, portions of these structures projected beyond the sides of the paper rolls and this prevented using the most efficient storage configuration.

It would be desirable to provide a spacer system which would require little or no special handling, which would provide for efficient storing of cylindrical articles, and which could easily be attached directly to the articles. Preferably the unit is disposable after a one time use.

SUMMARY OF INVENTION

The present invention provides a novel spacer unit that is particularly well suited to provide space under and between articles allowing an operator to use a forklift to move or handle the articles. Preferably, the unit is inexpensive and disposable so that it may be discarded after one use.

The spacer unit may be of any suitable shape, such as a cube or cylinder. A plurality of the spacer units are arranged in spaced relationship on the bottom of an article to be supported and are affixed to the bottom of the article. Preferably the units are affixed to a paper header that is first secured over the bottom of the article.

One preferred form of the spacer unit includes a cylindrical spacer member secured to a plate to form a composite spacer unit. In some cases, it is preferable to secure the spacer member between two plates. Preferably at least three of these composite spacer units are affixed to the bottom of an article, entirely within the bottom perimeter of the article, to provide sufficient space for insertion of the tines of a forklift truck or similar mechanism.

It is seen that the present invention is a striking departure from the teachings of conventional pallet design. The present invention eliminates the need to make and store large pallets before use. Further, by securing the spacer units of the present invention directly to the article, separate and more complex strapping operations are eliminated. Further, round paper rolls can be efficiently stored by means of the present invention since no portion of the spacer units project beyond the side of each roll.

BRIEF DESCRIPTION OF THE DRAWINGS

In the accompanying drawings forming part of the specification and in which like numerals are employed to designate like parts throughout, FIG. 1 is a perspective view of a large roll of paper wound on a hollow cylindrical core;

FIG. 2 is a perspective view from underneath a preferred embodiment of the spacer unit of the present invention that includes a spacer member and a plate;

FIG. 3 is a perspective view of the roll of paper of FIG. 1 viewed from below to illustrate four spacer units attached to the bottom of the roll to form a stackable paper roll assembly;

FIG. 4 is a bottom plan view of the assembly of FIG. 3;

DESCRIPTION OF THE PREFERRED EMBODIMENT

Figure 6:
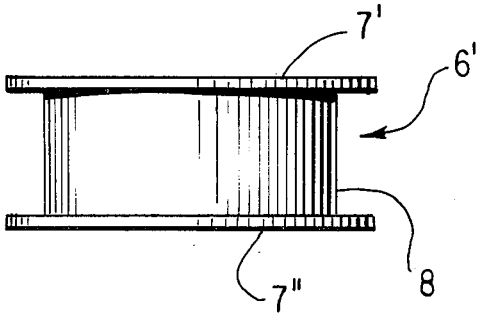
FIG. 6 is a side elevational view of an alternate embodiment of a composite spacer unit of the present invention.

The present invention may be used in many different forms. The specification and the accompanying drawings disclose only one specific form as an example of the use of the invention. The invention is not intended to be limited to the embodiment illustrated and the scope of the invention will be pointed out in the accompanying claims.

The precise shapes and sizes of the components herein described are not essential to the invention unless otherwise indicated.

For ease of description, the apparatus of this invention will be described in its normal operating position. It will be understood, however, that the apparatus of this invention may be used to provide spacing between articles horizontally as well as vertically.

Referring now to the drawings, FIG. 1 shows a large article such as a roll of paper 1 wound on a hollow cylindrical internal core 2 defining a cylindrical side wall 3, a circular top 4 and a circular bottom 5.

The roll of paper 1, being relatively heavy and not protected by an outside covering, could easily be damaged during handling. Especially susceptible to damage are the top 3 and bottom 5 of the roll. A roll with a damaged top or bottom might impede the operation of a machine (not illustrated) employed in the unwinding of the roll.

The present invention provides a novel method and structure for handling large or heavy articles, especially cylindrical articles. Specifically, a plurality of spacer units or members are arranged in a spaced relationship beneath an article and are secured directly to the article or to a bottom shield that is attached to the bottom of the article. The spacer members may be pads of suitable shapes, including, but not limited to, parallelpipeds, cubes, or cylinders.

FIG. 2 illustrates a first preferred embodiment of a spacer member in the form of a composite spacer unit 6 comprising a plate 7 affixed to a spacer member 8. Three or more of these units 6 can then be attached to the bottom of an article, such as roll 1 illustrated in FIGS. 3 and 4, to provide spacing to facilitate the use of a forklift or like mechanism.

The embodiment of the composite spacer unit 6 shown in FIG. 2 includes a plate 7 which is generally flat and rectangular. The plate has length and width dimensions greater than the spacer member 8 to which it is affixed. The plate 7 can be made of corrugated cardboard or solid fiberboard and can serve essentially two functions. First, it can provide a surface on which to place an attachment means, such as an adhesive, for attaching the composite unit 6 to the article. Second, the plate 7 may also serve as a bearing member distributing the weight of the article over a greater area. This reduces the concentrated load and aids in preventing damage to the end of the article.

If desired, the plate 7 may have a shape other than a rectangle, such as a circle or triangle. The minimum dimension across the plate 7 should, of course, be equal to, or greater than, the dimension across the spacer member 8. That is, the plate 7 should be of any suitable planar shape and size such that it extends at least to, if not beyond, the outer periphery of the spacer member 8.

The spacer member 8, shown in the preferred embodiment as a hollow cylinder, supports the weight of the article and maintains a space between either the article and the floor or between the article and another article stacked beneath it. In the preferred embodiment, the spacer member 8 can be constructed of a section of paper core and can be adhesively attached to the plate 7.

When the article to be handled is a roll of paper such as roll 1 in the figures, it may be desirable in some circumstances to protect the ends of the roll and provide a cover surface on the end of the roll to which the composite spacer unit can be attached without damaging the end of the roll.

An arrangement is shown in FIG. 3 wherein a shield 9 is placed on each end of the paper roll. The shield 9 may be made of a suitable flexible material, such as a sheet of paper or the like, and is typically referred to as a "paper header." The shields 9 preferably have dimensions greater than the diameter of roll 1 leaving a peripheral margin 10 that is folded along side wall 3 and fastened to the paper roll by a strap 11. Preferably, as illustrated in FIGS. 3 and 4, four composite spacer units 6 are attached to the bottom shield 9 within the diameter of the paper roll 1.

Figure 5:
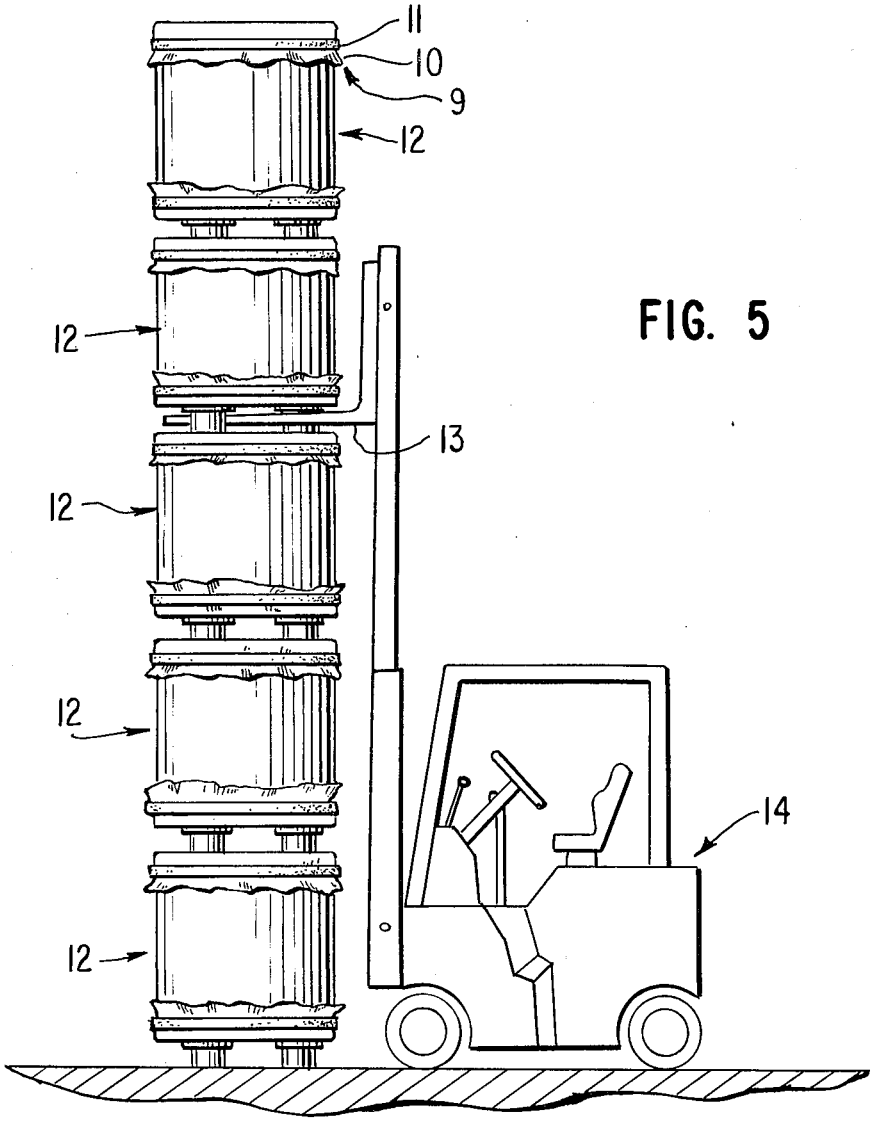
FIG. 5 is a side elevational view of five paper roll assemblies stacked one upon the other and showing a forklift truck in a position ready to lift two of the paper rolls assemblies.

The completed assembly shown in FIG. 3 may be described as a stackable paper roll assembly 12. In this form there is sufficient space under and between the rolls of paper to allow the insertion of the tines 13 of a forklift 14 as shown in FIG. 5. It therefore becomes possible to handle the rolls without damage.

With many products, including tightly wound rolls of heavy paper, the benefits of using a shield 9 on the top end of each roll are minimal so that the top shields 9 may be eliminated. The bottom shield 9 functions primarily to provide a mounting surface for the composite unit 6 and to prevent adhesive material from contacting the roll 1.

In the preferred form, the spacer member 8 is cylindrical. Then, if a tine of a forklift truck accidentally hits the spacer member, there will be a greater likelihood of the tine glancing off of the spacer member without damaging the spacer member.

FIG. 6 illustrates an alternate embodiment of a composite spacer unit 6' which is preferred in certain applications, such as with heavy rolls of paper. The unit 6' is similar to the unit 6 illustrated in FIG. 2 and described above in that it has a cylindrical spacer member 8' affixed to a top plate 7'. However, unit 6' further has a bottom plate 7'' secured to the end of the spacer member 8' opposite the top plate 7'. The bottom plate 7'' functions to distribute the load of a first product to which the unit 6' is attached. This prevents damage to a second product, such as another paper roll, upon which the first product is placed. Both the top plate 7' and bottom plate 7'' may have non-circular planar shapes if desired. Each plate should be of any suitable shape and size such that it extends at least to, if not beyond, the outer periphery of the spacer member 8'.

In another form of the invention, the plates or plate at the bottom of the paper roll are not required. Instead, pads of a suitable material may be secured directly to the paper header at the bottom of the roll. The horizontal cross-section of the pads or plates may be circular, rectangular, square or any other suitable shape and the pads would have a thickness sufficient to provide a space under the paper roll for receiving the tines of the forklift.

The foregoing specification is intended as illustrative and is not to be taken as limiting. Still other variations within the spirit and scope of the invention are possible and will readily present themselves to those skilled in the art.

What is claimed is:

1. A method for stacking rolls of paper or the like to facilitate handling with a forklift or like mechanism having a cantilevered lifting member, each roll having the shape of a cylinder with a cylindrical side wall extending between a circular top and a circular bottom, this method comprising the steps of:

(a) providing a plurality of generally identical spacer members and a plurality of generally identical plates with each spacer member having first and second ends and a height at least as great as the thickness of the lifting member and with each plate having a planar area at least equal to the area defined by the outer periphery of each spacer member;

(b) affixing to said first end of each said spacer member one of said plates and affixing to said second end of each said spacer member another of said plates with each plate being affixed to only one of said spacer members and with each plate extending across a spacer member at least to the outer periphery of the spacer member to thereby form a composite spacer unit adapted to be disposed on the bottom of one of the rolls;

(c) providing a protective shield for each roll and fastening one of said protective shields to each roll to cover at least the bottom of each roll;

(d) locating at least three of said composite spacer units on the shield at the bottom of each of the rolls at locations spaced apart by an amount sufficient to accommodate insertion of said lifting member between said composite spacer units;

(e) attaching at least three of said composite spacer units to the shield on the bottom of each of the rolls at said spaced-apart locations with one plate of each unit attached to, and in contact with, the bottom shield to form a stackable roll assembly; and (f) stacking one of the roll assemblies on top of another of said roll assemblies with the composite spacer units attached to the bottom of the upper roll assembly resting on the top of the lower roll assembly whereby the lifting member can be received between the stacked roll assemblies.

2. The method of claim 1 wherein each shield is a paper sheet and wherein step (c) includes (1) placing one of the paper sheets against the bottom of a selected roll, (2) folding the peripheral margin of the one paper sheet along the cylindrical side wall of the selected roll, and (3) fastening the one paper sheet to the selected roll with a strap.

3. The method of claim 1 wherein step (b) includes adhesively affixing the plates to the spacer member and wherein step (e) includes adhesively securing a plate of each composite spacer unit to the bottom of one of said rolls.

4. A stackable assembly of a roll of paper or the like which facilitates handling with a forklift or like mechanism having a cantilevered lifting member, this assembly comprising:

(a) a roll having a circular top and bottom at opposite ends of a cylindrical exterior surface;

(b) a protective shield secured to said roll and covering at least the entire bottom of said roll, said shield having at least one dimension at least equal to the diameter of said roll; and (c) at least three composite spacer units disposed on the shield at the bottom of said roll at locations spaced apart by amounts sufficient to accommodate insertion of said lifting member between said composite spacer units, each said composite spacer unit comprising:

(1) a spacer member having first and second ends and a height at least as great as the thickness of the lifting member, (2) a first plate having a planar area at least equal to the area defined by the outer periphery of said spacer member, said first plate being attached to, and in contact with, the shield on the bottom of said roll, said first plate being affixed to said first end of only one said spacer member with the plate extending across said one spacer member first end at least to the outer periphery of said one spacer member, and (3) a second plate affixed to said second end of only said one spacer member with said second plate extending across said one spacer member at least to the outer periphery of the spacer member, whereby said composite spacer units on a roll form a stackable roll assembly which can be stacked on top of another similar roll assembly with the composite spacer units of one roll assembly resting on the top of the other roll assembly with said second plate of each said spacer unit functioning to distribute the weight force and whereby the lifting member can be received between the stacked roll assemblies.

5. The assembly of claim 4 wherein the side of each first plate which is disposed against a shield is attached with adhesive to the shield.

6. The assembly of claim 4 wherein said shield is a sheet of material with the margins of the sheet folded over and retained on each roll with a strap loop binding the sheet margins to the cylindrical surface of the roll.

7. The assembly of claim 4 wherein the spacer member is a hollow cylinder fabricated from a paper material and wherein each plate is flat and fabricated from corrugated paper.

8. The assembly of claim 4 wherein each plate has a rectangular planer configuration and wherein each plate is adhesively affixed to said spacer member.

* * * * *